US011021828B2

(12) United States Patent
Yang

(10) Patent No.: US 11,021,828 B2
(45) Date of Patent: Jun. 1, 2021

(54) WASHING MACHINE

(71) Applicant: LG Electronics Inc., Seoul (KR)

(72) Inventor: Jinrock Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 268 days.

(21) Appl. No.: 16/301,757

(22) PCT Filed: May 25, 2017

(86) PCT No.: PCT/KR2017/005469

§ 371 (c)(1),
(2) Date: Nov. 15, 2018

(87) PCT Pub. No.: WO2017/204578

PCT Pub. Date: Nov. 30, 2017

(65) Prior Publication Data

US 2019/0284745 A1 Sep. 19, 2019

(30) Foreign Application Priority Data

May 27, 2016 (KR) ..... 10-2016-0065440

(51) Int. Cl.

| | |
|---|---|
| ***D06F 34/28*** | (2020.01) |
| ***D06F 39/14*** | (2006.01) |
| ***D06F 37/24*** | (2006.01) |
| ***D06F 37/42*** | (2006.01) |
| ***D06F 37/12*** | (2006.01) |
| ***D06F 37/26*** | (2006.01) |

(52) U.S. Cl.

CPC ..... *D06F 34/28* (2020.02); *D06F 37/12* (2013.01); *D06F 37/24* (2013.01); *D06F 37/26* (2013.01); *D06F 37/42* (2013.01); *D06F 39/14* (2013.01)

(58) Field of Classification Search

CPC ..... D06F 34/28

See application file for complete search history.

(56) References Cited

FOREIGN PATENT DOCUMENTS

| | | |
|---|---|---|
| KR | 1020040020719 | 3/2005 |
| KR | 10-1014711 | 2/2011 |
| KR | 1020060032749 | 10/2012 |
| KR | 1020060109162 | 2/2013 |
| KR | 1020110013130 | 6/2016 |

*Primary Examiner* — Jason Y Ko

(74) *Attorney, Agent, or Firm* — Finnegan, Henderson, Farabow, Garrett & Dunner, LLP

(57) ABSTRACT

A washing machine according to an embodiment of the present invention may comprise: a cabinet accommodating a washing drum; a top cover seated on the top surface of the cabinet and having a door seating part formed therein; a door that is pivotally seated on the door seating part; a panel case mounted to the top surface of the top cover corresponding to the rear side of the door, the panel case including a front case and a rear case coupled to the rear surface of the front case; a control panel provided on the front surface of the front case; and a panel-deco coupled to the front surface of the front case corresponding to the bottom side of the control panel, the panel-deco opening and closing a coupling portion of the front case and the top cover.

8 Claims, 11 Drawing Sheets

WASHING MACHINE

CROSS-REFERENCE TO RELATED APPLICATIONS

This application is the National Stage filing under U.S.C. § 371 of International Application No. PCT/KR2017/005469, filed on May 25, 2017, which claims the benefit of earlier filing date and right of priority to Korean Application No. 10-2016-0065440, filed on May 27, 2016, the contents of which are hereby incorporated by reference herein in their entirety.

TECHNICAL FIELD

The present invention relates to a washing machine.

BACKGROUND ART

A washing machine includes a top loading type washing machine, in which an inlet for putting laundry is provided in an upper surface of a cabinet, a rotation shaft of a washing tub is vertically disposed, and washing is performed by a rotating water flow generated when the washing tube rotates, and a front loading type washing machine, in which an inlet is provided in a front surface of a cabinet, a rotation shaft of a washing tub extends in a front and rear direction of the cabinet, and washing is performed by using collision of the laundry, which drops when the washing tub rotates, with washing water.

Particularly, the top loading type washing machine includes a cabinet accommodating a washing tub and a tub therein, a top cover seated on a top surface of the cabinet, a panel case mounted on a rear end of the top surface of the top cover, and a control panel attached to a front surface of the panel case.

A top loading type washing machine including a top cover seated on a top surface of a cabinet and a control panel mounted on the top cover is disclosed in following prior art document 1. In detail, a lower end of a front surface of the control panel, particularly, a left lower end and a right lower end of a front surface of the control panel, which contacts the top cover, are disposed behind a rear end of a door covering a laundry inlet.

According to this structure, there is no feeling of connection between a lower end of the control panel and the top cover.

Also, a gap between the lower end of the control panel and the top cover may occur, and thus, water or foreign substances may be easily introduced into the control panel through the gap. For example, water flowing down along an edge of each of left and right sides of the front surface of the control panel may be easily introduced into the control panel.

DISCLOSURE OF THE INVENTION

Technical Problem

The present disclosure has been proposed to improve the above-described limitations.

Technical Solution

To achieve the above object, a washing machine according to an embodiment of the present invention may include: a cabinet configured to accommodate a washing drum; a top cover which is seated on a top surface of the cabinet and on which a door seating part is disposed; a door rotatably seated on the door seating part; a panel case mounted on a top surface of the top cover, which corresponds to a rear side of the door, and including a front case and a rear case coupled to a rear surface of the front case; a control panel disposed on a front surface of the front case; and a panel decor coupled to the front surface of the front case, which corresponds to a lower side of the control panel, to cover a coupled portion of the front case and the top cover.

Also, each of left and right lower ends of the front surface of the front case may include an extension end further extending forward than a rear end of the door seating part. Thus, a degree of close contact between a portion of the front case and the top cover may be improved to minimize possibility of introduction of foreign substances into the panel case, and the front case may appear to be continuous with the top cover.

Also, the panel decor may include at least one of a decor body having a length corresponding to a width of the door seating part, a plurality of coupling hooks protruding from an upper end of a rear surface of the door body, a pair of coupling bosses respectively protruding from left and right points of the rear surface of the decor body, a pair of pressing protrusions respectively protruding from left and right points of the rear surface of the decor body, and a plurality of movement prevention ribs extending from the rear surface of the decor body.

A lower end of the decor body may be bent or rounded downward and closely attached to the rear end of the door seating part. Thus, water flowing down along a surface of the panel decor may flow into the door seating part without being introduced into the panel case.

Also, the washing machine according to an embodiment of the present invention may include at least one of a plurality of movement prevention grooves which are defined in a lower portion of the front surface of the front case and to which the plurality of movement prevention ribs are coupled, a plurality of hook holes which are defined in the front surface of the front case and into which the plurality of coupling hooks are inserted, an interference prevention hole defined in left and right sides of the front case to prevent an interference with the pressing protrusions, and a hook protrusion which is disposed at a rear side of the interference prevention hole and to which an end of each of the coupling bosses is closely attached.

Also, each of the pressing protrusions may be disposed below each of the coupling bosses.

Also, the washing machine according to an embodiment of the present invention may further include a plurality of fitting protrusions extending from a bottom surface of a front end of the front case, a plurality of coupling holes defined in the bottom surface of the front end of the front case, which corresponds to positions between the plurality of fitting grooves, a plurality of coupling slits defined in any points of the top cover, which correspond to positions of the plurality of fitting protrusions in the state in which the front case is seated on the top cover, and a plurality of coupling holes defined in any points of the top cover, which correspond to positions of the plurality of coupling holes.

Advantageous Effects

The washing machine including the foregoing constitutions according to the embodiment of the present invention has following effects.

First, the edges of the left and right sides of the lower end of the front surface of the panel case seated on the top cover may be smoothly rounded to further extend than the rear end of the door accommodation part provided in the top cover, thereby realizing the feeling of connection between the panel case and the top cover as the single body.

Second, the left and right edges of the lower end of the front surface of the panel case may extend forward to reduce the separation of the lower end of the panel case from the top surface of the top cover, thereby minimizing the introduction of the foreign substances into the panel case.

Third, the lower end of the panel decor may be bent downward to guide the water flowing along the front surface of the panel case into the washing tub, thereby minimizing the introduction of the water into the panel case.

MODE FOR CARRYING OUT THE INVENTION

Hereinafter, a washing machine according to an embodiment of the present invention will be described in detail with reference to the accompanying drawings.

Figure 1:
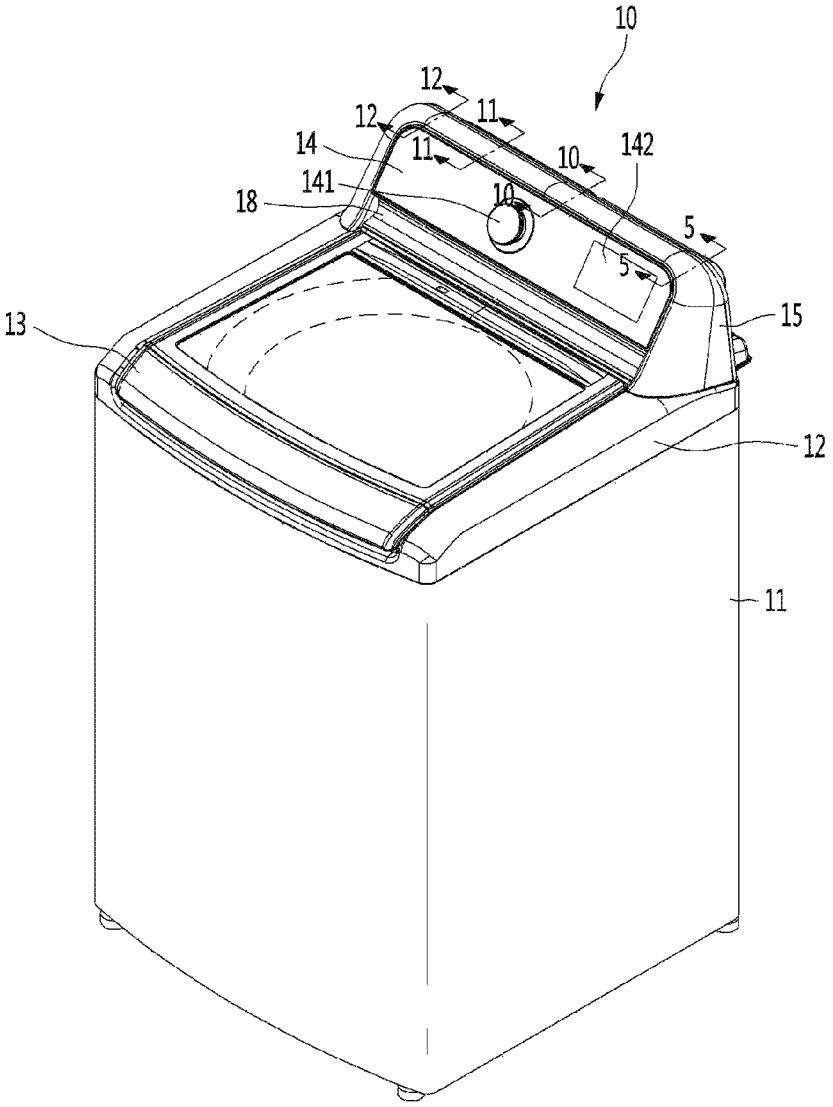
FIG. 1 is a perspective view of a washing machine according to an embodiment of the present invention.

FIG. 1 is a perspective view of a washing machine according to an embodiment of the present invention.

Referring to FIG. 1, a washing machine 10 according to an embodiment of the present invention may include a cabinet 11, a top cover 12 seated on a top surface of the cabinet 11, a panel case 15 mounted on a rear side of a top surface of the top cover 12, a control panel 14 attached to a front surface of the panel case 15, a panel decor 18 mounted on the front surface of the panel case 15, which corresponds to a lower side of the control panel 14, and a door rotatably mounted inside the top cover 12.

In detail, a washing drum into which laundry is put and a tub accommodating the washing drum are mounted inside the cabinet 11. Also, a washing motor is mounted on a bottom surface of the tub, and a dehydration shaft and a washing shaft are mounted on a central portion of the washing drum and the tub. Also, a lower end of the washing shaft is connected to a rotor of the washing motor in a state of being accommodated in the dehydration shaft. Also, a pulsator is mounted on an upper end of the washing shaft.

Also, the control panel 14 may include a manipulation unit 141 for inputting washing conditions and a display unit for displaying various information including a washing state. Also, various electric components enabling an operation of the control panel 14 are accommodated in the panel case 15.

Figure 2:
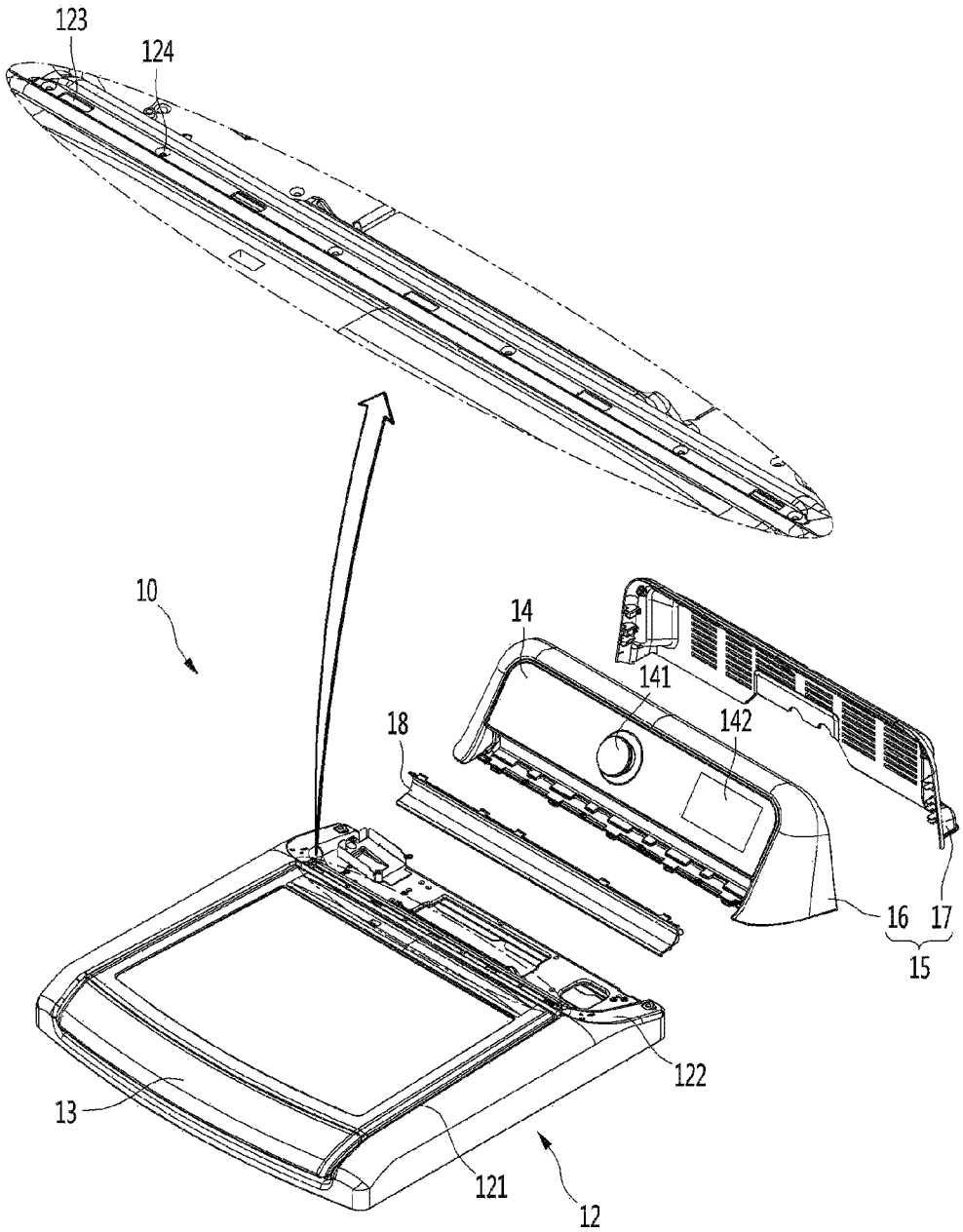
FIG. 2 is an exploded perspective view illustrating a configuration of an upper portion of a cabinet of the washing machine according to an embodiment of the present invention.

FIG. 2 is an exploded perspective view illustrating a configuration of an upper portion of the cabinet of the washing machine according to an embodiment of the present invention.

Referring to FIG. 2, a door seating part 121 on which the door 13 is seated is disposed inside the top cover 13 according to an embodiment of the present invention. The door seating part 121 may be a hole having a shape corresponding to that of the door 13.

In detail, a panel case seating part 122 on which the panel case 15 is seated may be provided on the top surface of the top cover 12 from a rear end of the door seating part 121 to a rear end of the top cover 12. Also, a plurality of coupling slits 123 and a plurality of coupling holes 124 may be defined at predetermined intervals in an edge of a front end of the panel case seating part 122. Also, the plurality of coupling slits 123 and coupling holes 124 may be alternately arranged in a widthwise direction of the top cover 12.

The panel case 15 may include a front case 16 and a rear case 17. The control panel 14 may be seated on a front surface of the front case 16. The rear case 17 is coupled to a rear surface of the front case 16 to define a space for accommodating the electric components.

Figure 3:
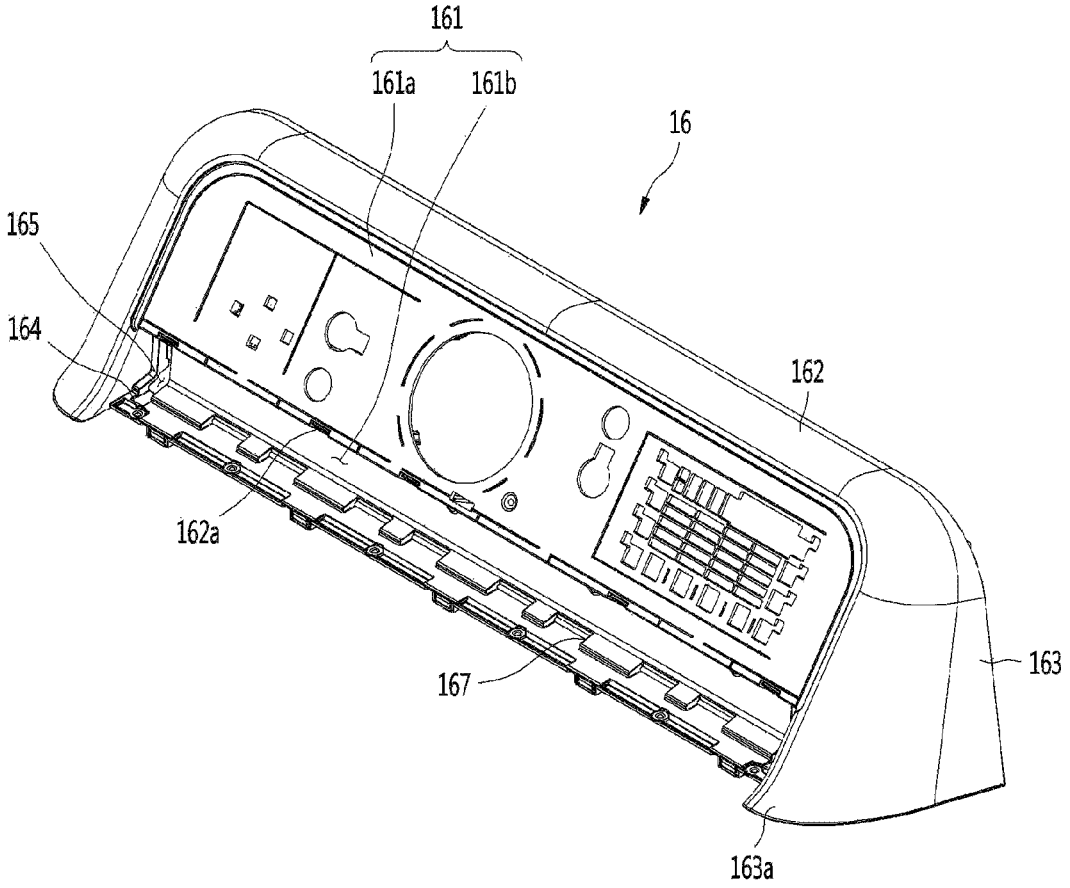
FIG. 3 is a front perspective view of a front case constituting the panel case according to an embodiment of the present invention.
Figure 4:
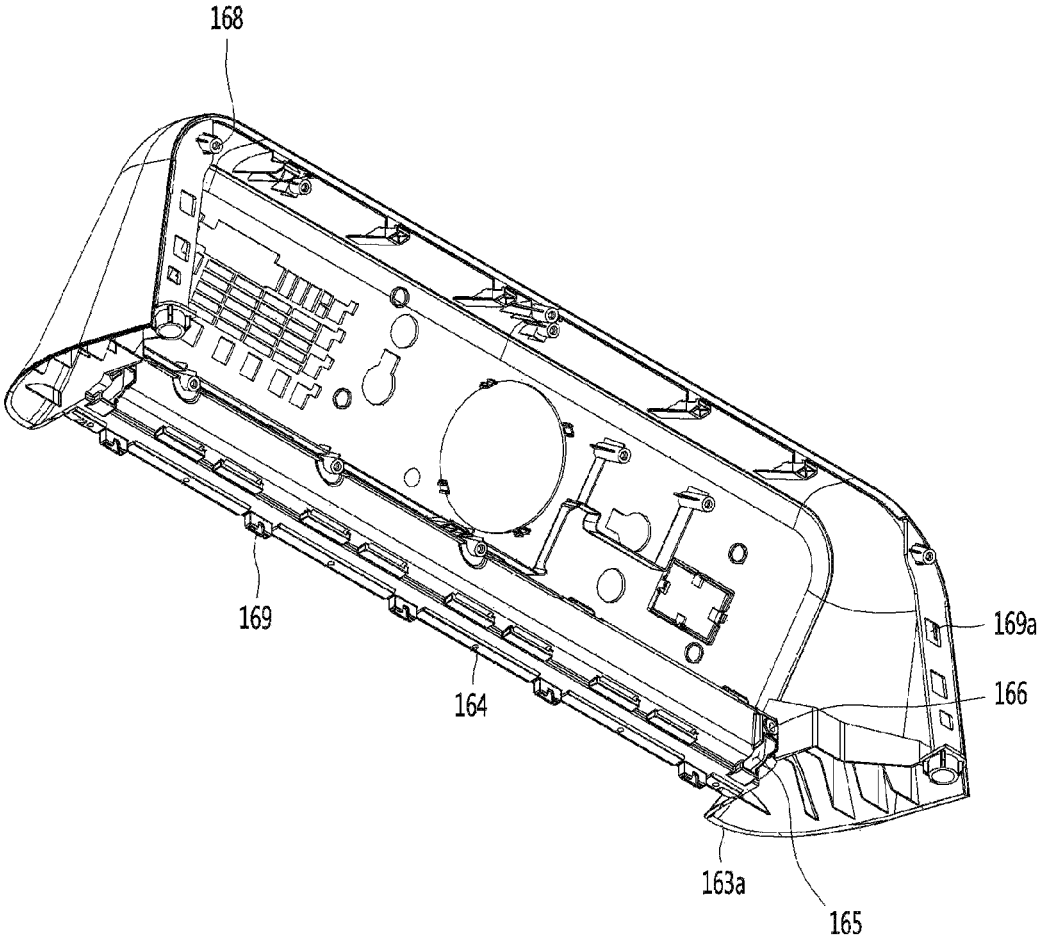
FIG. 4 is a rear perspective view of the front case.

FIG. 3 is a front perspective view of the front case constituting the panel case according to an embodiment of the present invention, and FIG. 4 is a rear perspective view of the front case.

Referring to FIGS. 3 and 4, the front case 16 according to an embodiment of the present invention may include a front surface part 161, a side surface part 163 disposed along an edge of the front surface part 161, and a top surface part 162.

In detail, the side surface part 163 may include a left surface part defining a left edge of the front case 16 and a right surface part defining a right edge of the front case 16. Also, the top surface part 162 extends along an upper edge of the front surface part 161 to connect the left surface part to the right surface part. Also, an edge portion of the front case 16, at which the side surface part 163 and the top surface part 162 meet each other, may be rounded at a predetermined curvature.

Also, the front surface part 161 may include a control panel seating part **161*a* on which the control panel 14 is seated and a panel decor coupling part 161*b* which is provided below the control panel seating part 161 and on which the panel decor 18** is mounted.

Also, a lower end of a front surface of each of the left surface part and the right surface part may extend further than the rear end of the door seating part 121 in a state of being seated on the top cover 12. Here, the extending portion may be defined as an extension end **163*a*. The extension end 163*a* may extend to be smoothly rounded. Here, the extension end 163*a* may extend toward the front end of the top cover 12. Also, the extension end 163*a* extends along an edge of a side surface of the door seating part 121**.

Also, a plurality of coupling holes 164 may be defined to be spaced apart from each other in the widthwise direction of the front case 16 at the lower end of the front surface of the front case 16 corresponding to the panel decor coupling part **161*b*. Also, a plurality of hook holes 162*a* may be defined to be spaced apart from each other in the widthwise direction of the front case 16 in an upper end of the panel decor coupling part 161***b*, i.e., a boundary portion of the control panel seating part 161*a*.

Also, a plurality of fitting protrusions 169 may protrude from the bottom of the front surface of the front case 16. Also, the plurality of fitting protrusions 169 may be disposed to be spaced apart from each other in the widthwise direction of the front case 16. In more detail, the plurality of fitting protrusions 169 and the plurality of coupling holes 164 may be alternately disposed at predetermined intervals in the widthwise direction of the front case 16.

Also, a plurality of movement prevention grooves 167 may be defined to be spaced apart from each other in the widthwise direction of the front case 16 in the panel decor coupling part 161*b*.

Also, an interference prevention hole 165 may be defined in each of left and right edges of the panel decor coupling part 161*b*, and a coupling protrusion 166 may be disposed above the interference prevention hole 165. A coupling hole is defined in the coupling protrusion 166.

Also, a plurality of rear case coupling bosses 168 may protrude from an edge of the rear surface of the front case 16. Also, a plurality of rear case fixing holes 169*a* may be defined in a rear surface of the side surface part 163.

Figure 5:
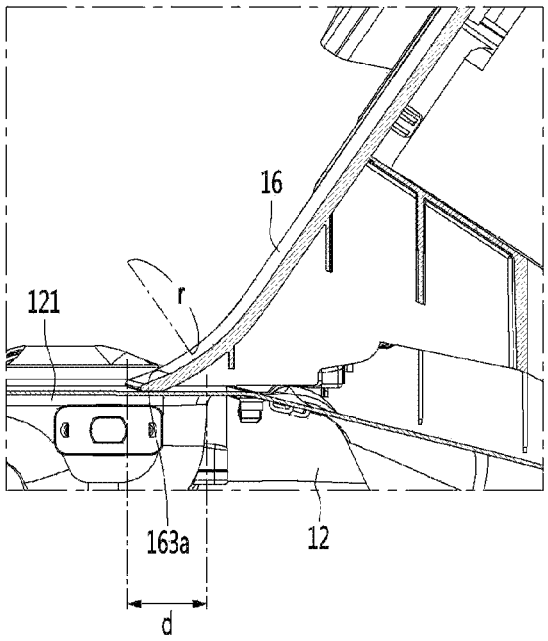
FIG. 5 is a longitudinal cross-sectional view taken along line 5-5 of FIG. 1.

FIG. 5 is a cross-sectional view taken along line 5-5 of FIG. 1.

Referring to FIG. 5, the lower end of the front surface of the front case 16 extends forward to be rounded at a predetermined curvature 'r'. Also, the lower end of the front surface of the front case 16, i.e., an end of the extension part 163*a* extends to be spaced a predetermined distance 'd' from the rear end of the door seating part 121 to the front side of the top cover 12. Thus, introduction of water flowing along the left and right edges of the front surface part of the front case 16 into the panel case 15 may be minimized.

Figure 6:
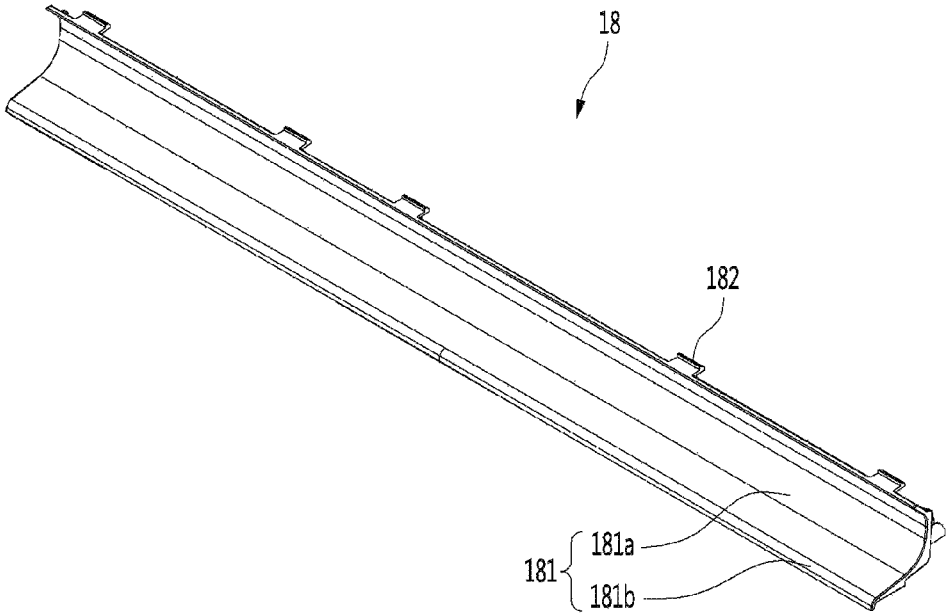
FIG. 6 is a front perspective view of a panel decor according to an embodiment of the present invention.
Figure 7:
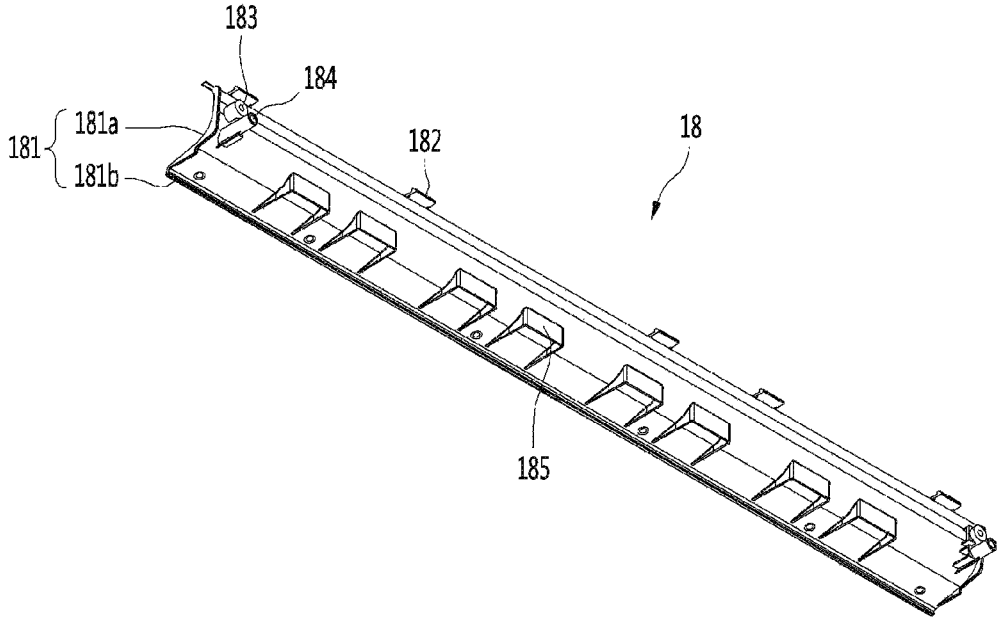
FIG. 7 is a rear perspective view of the panel decor.

FIG. 6 is a front perspective view of the panel decor according to an embodiment of the present invention, and FIG. 7 is a rear perspective view of the panel decor.

Referring to FIGS. 6 and 7, the panel decor 18 according to an embodiment of the present invention may be mounted on the lower end of the front surface of the front case 16 to prevent a coupling member for coupling the front case 16 to the top cover 12 from being exposed to the outside.

In detail, the panel decor 18 may include a decor body 181, a coupling hook 182 protruding backward from an upper end of a rear surface of the decor body 181, a movement prevention rib 185 extending downward from a rear surface of the decor body 181, a pair of coupling bosses protruding backward from left and right edges of the rear surface of the decor body 181, and a pair of pressing protrusions 184 protruding backward from a lower side of the coupling bosses 183. Also, the panel decor 18 may have substantially the same width and length as the door seating part 121.

In more detail, the decor body 181 may include a rounded part 181*a* extending downward to extend forward while being smoothly rounded and a bent part 181*b* bent downward from an end of the rounded part 181*a*.

Also, the coupling hook 181 may be provided in plurality. The plurality of coupling hooks 181 may be disposed to be spaced apart from each other in a longitudinal direction of the decor body 181.

Also, the pressing protrusion 184 may be configured so that a user pushes the rear case 17 backward by using his hands after separating the rear case 17 when it is intended to separate the panel decor 18 from the panel decor coupling part 161*b*. That is, when the user pushes the pressing protrusion 184 forward after separating the coupling member coupled to the coupling bosses 183, the panel decor 181 may rotate to be separated from the panel decor coupling part 161*b*.

Also, the movement prevention rib 185 may be provided in plurality on the rear surface of the panel decor 18. The plurality of movement prevention ribs 185 may be disposed to be spaced apart from each other in the width of the panel decor 18. Also, when the panel decor 18 is seated on the panel decor coupling part 161*b* of the front case 16, the movement prevention rib 185 is fitted into the movement prevention groove 167. Thus, since the panel decor 18 does not move in a left and right direction in the state of being seated on the panel decor coupling part 161*b*, the coupling member may be easily coupled to the coupling boss 183.

Also, an end of the coupling boss 183 may be closely attached to the coupling protrusion 166, and thus, the coupling groove defined in the coupling boss 183 and the coupling hole defined in the coupling protrusion 166 may be aligned with each other. Also, the coupling member such as a screw may be inserted into the coupling boss 183 by passing through the coupling protrusion 166.

Also, the pressing protrusion 184 protrudes backward from the front case 16 through the interference prevention hole 165 to allow the user's finger to push the front case 16 backward. In detail, when the panel decor 18 is coupled to the panel decor coupling part 161*b*, the pressing protrusion 184 rotates in the state of being inserted into the interference prevention hole 165 to protrude backward from the front case 16

Also, the coupling hook 182 is inserted into the hook hole 162*a*.

Figure 8:
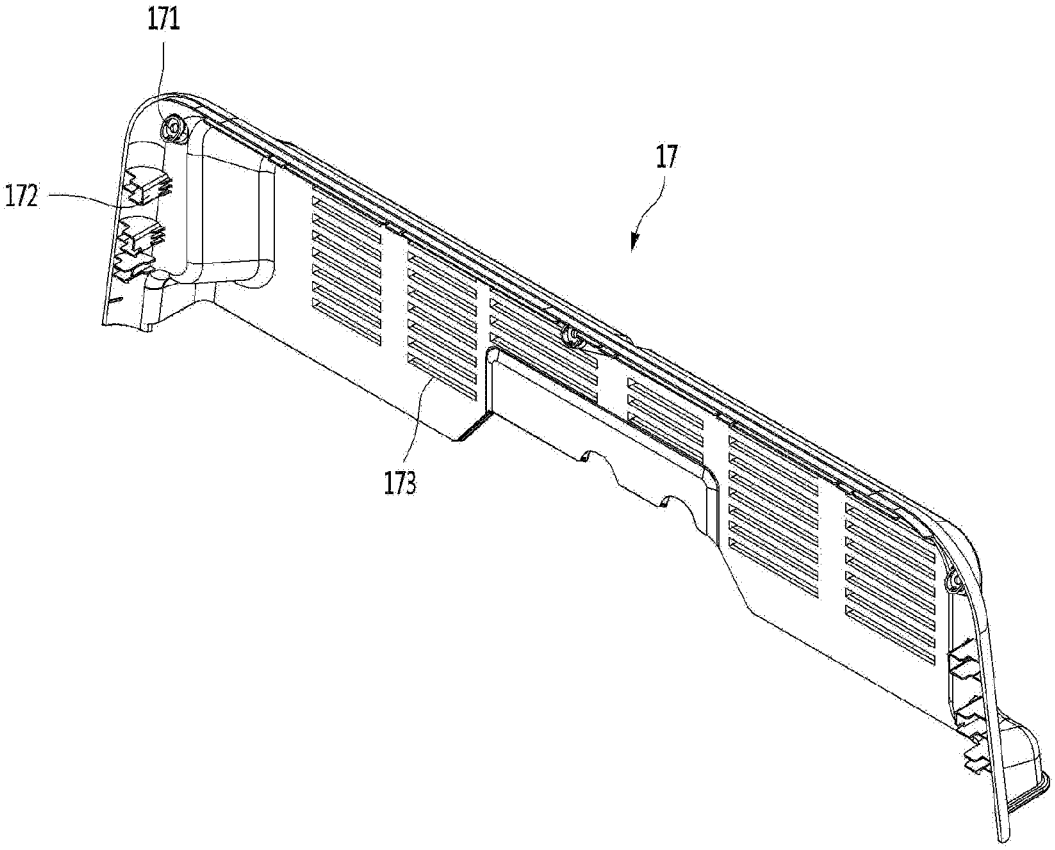
FIG. 8 is a front perspective view of a rear case constituting the panel case according to an embodiment of the present invention.
Figure 9:
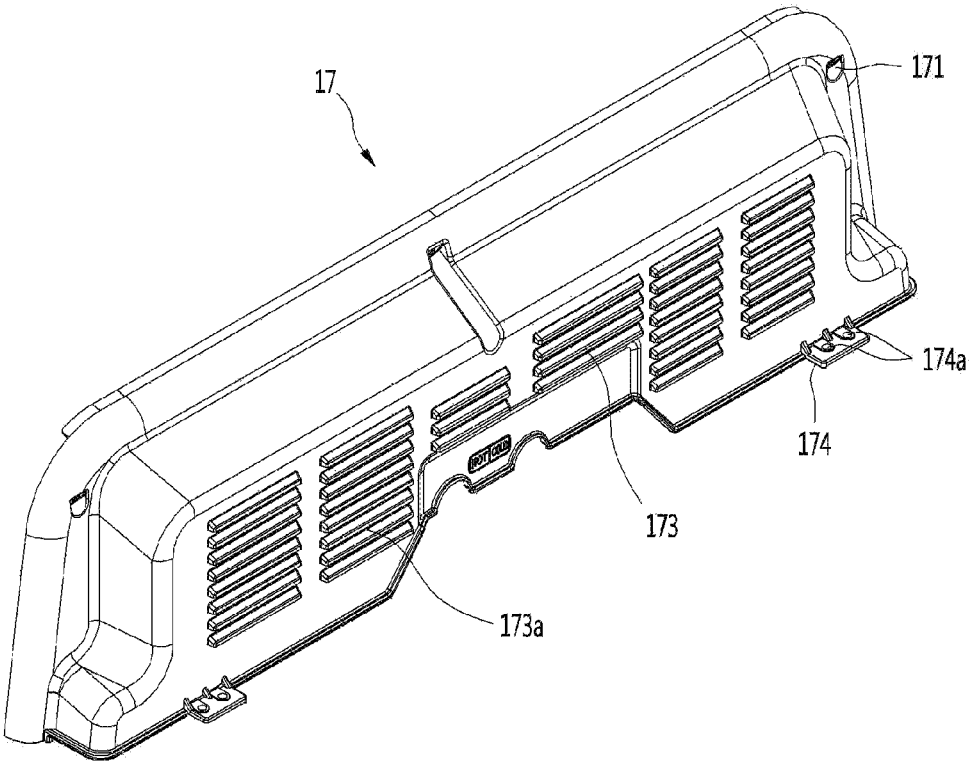
FIG. 9 is a rear perspective view of the rear case.

FIG. 8 is a front perspective view of the rear case constituting the panel case according to an embodiment of the present invention, and FIG. 9 is a rear perspective view of the rear case.

Referring to FIGS. 8 and 9, the rear case 17 according to an embodiment of the present invention is coupled to the rear surface of the front case 16.

In detail, a front edge of the rear case 17 is closely attached to a rear edge of the front case 16, and a plurality of coupling holes 171 are defined in an inner edge of the rear case 17. The plurality of coupling holes 171 may be defined at points corresponding to the positions of the plurality of rear case coupling bosses 168 protruding from the rear surface of the front case 16. Thus, in the state in which the rear case 17 is closely attached to the rear surface of the front case 16, the coupling member such as the screw may be inserted into the rear case coupling bosses 168 by passing through the coupling holes 171.

Also, a plurality of fixing ribs 172 may protrude from the left and right edges of the front surface part of the rear case 17. The plurality of fixing ribs 172 may be inserted into rear case fixing holes 169*a* of the rear surface of the front case 16. In the state in which the plurality of fixing ribs 172 are inserted into the rear case fixing holes 169*a*, movement of the rear case may be prevented. In this state, the coupling member may be inserted into the coupling hole 171.

Also, a plurality of heat dissipation holes 173 may be defined in the rear case 17. Each of the plurality of heat dissipation holes 173 may formed in such a manner that a portion of the rear case 17 is cut or bent. In detail, a portion of the rear case 17 may be cut in a U shape, and the cut portion may be bent to form a guide rib 173*a* having a louver shape together with the heat dissipation hole 173. Thus, air within the panel case 15 may be discharged to the outside through the heat dissipation holes 173 and then be guided to the bottom surface, on which the washing machine is installed, by the guide rib 173*a*.

The coupling ribs 174 may be disposed on the left and right edges of the lower end of the rear surface of the rear case 17, respectively. Here, one or more coupling holes 174*a* may be defined in each of the coupling ribs 174.

Figure 10:
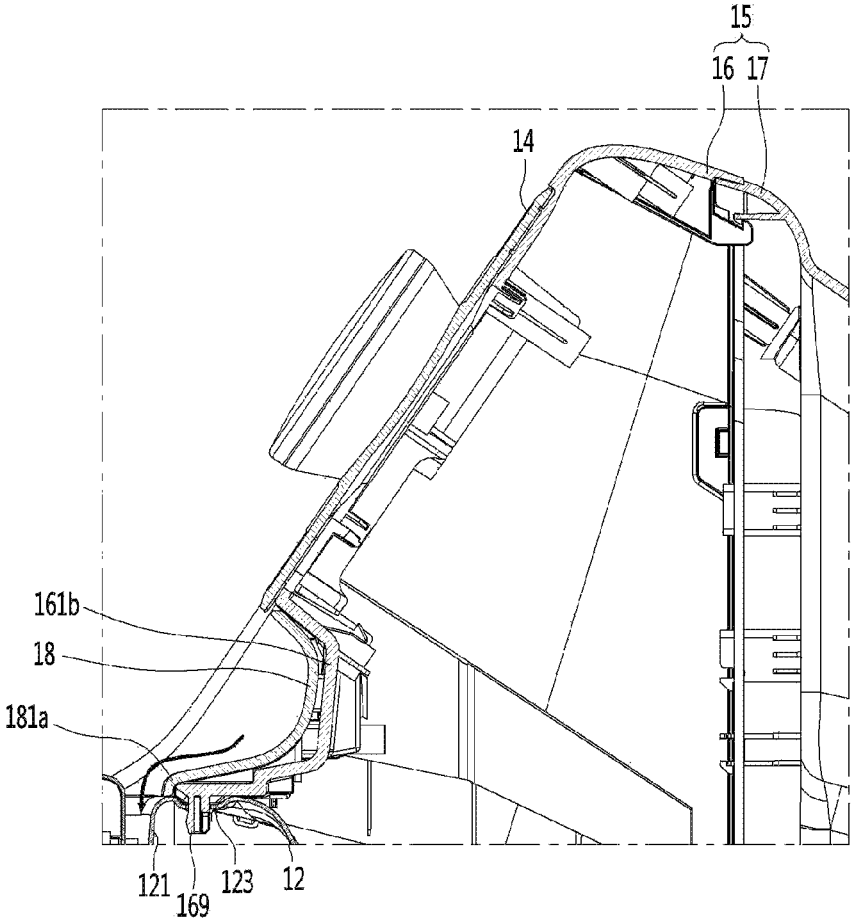
FIG. 10 is a longitudinal cross-sectional view taken along line 10-10 of FIG. 1.
Figure 11:
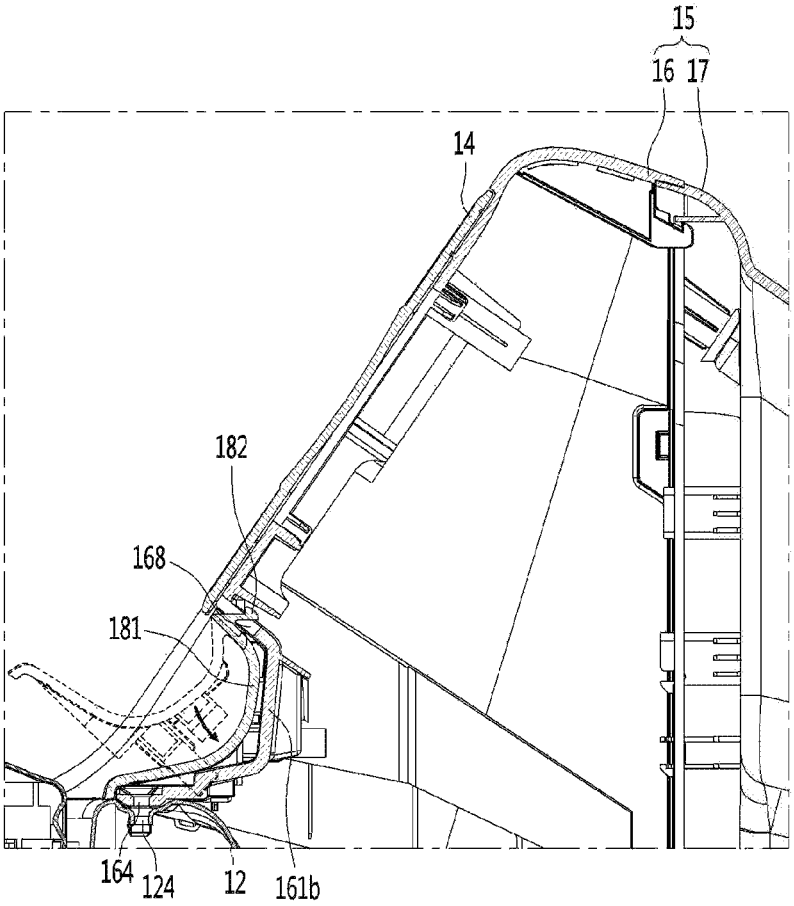
FIG. 11 is a longitudinal cross-sectional view taken along line 11-11 of FIG. 1.
Figure 12:
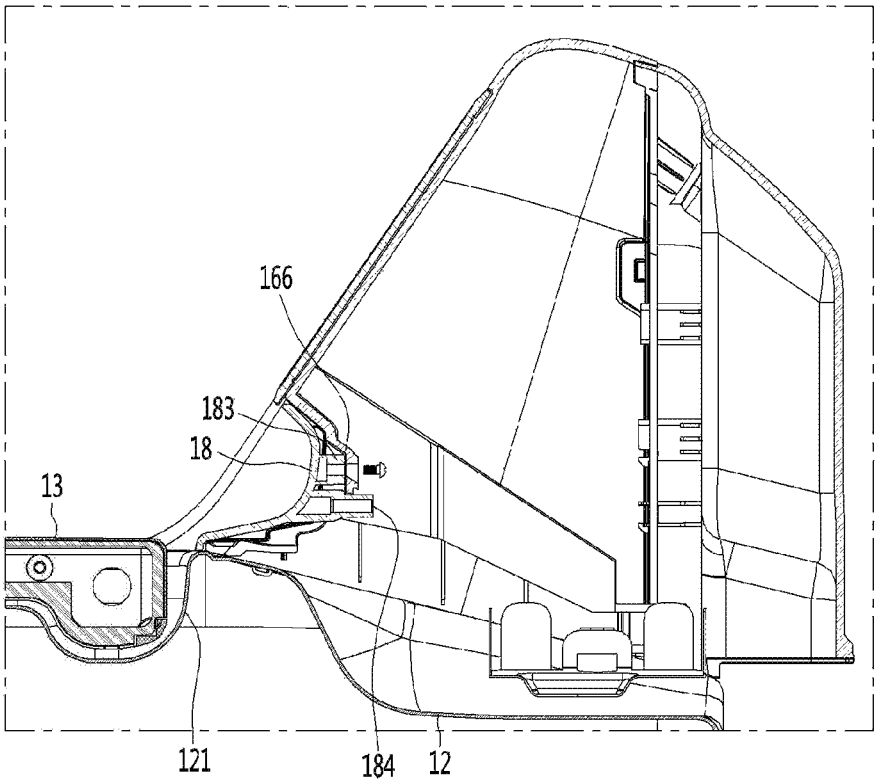
FIG. 12 is a longitudinal cross-sectional view taken along line 12-12 of FIG. 1.

FIG. 10 is a longitudinal cross-sectional view taken along line 10-10 of FIG. 1, FIG. 11 is a longitudinal cross-sectional view taken along line 11-11 of FIG. 1, and FIG. 12 is a longitudinal cross-sectional view taken along line 12-12 of FIG. 1.

Referring to FIGS. 10 to 12, the panel decor 18 covers the coupling structure of the lower end of the front case 16 and the top cover 12.

In detail, as illustrated in FIG. 10, the front case 16 may descend from an upper side of the top cover 12 so that the fitting protrusion 169 extending from the bottom surface of the front end of the front case 16 is inserted into the coupling slit 123 of the top cover 12.

Also, as illustrated in FIG. 11, the coupling member such as the screw is inserted into the coupling hole 164 defined in the bottom of the front end of the front case 12 and the coupling hole 124 defined in the top surface of the top cover 12. Thus, the front case 16 may be stably fixed to the panel case seating part 122 of the top cover 12.

Also, as illustrated in FIG. 11, the panel decor 18 is mounted on the panel decor seating part 161*b*. In detail, as illustrated as a dotted line of FIG. 11, in the state in which the coupling hook 182 of the panel decor 18 is inserted into the hook hole 162*a* defined in the front case 16, the panel decor 18 rotates in a direction (a first direction) in which the panel decor 18 is closely attached to the front surface of the front case 16. Thus, the pressing protrusion 184 of the panel decor 18 may rotate in the state of being inserted into the interference prevention hole 165 of the front case 16 to become a horizontal state. As described above, the coupling boss 183 is closely attached to the coupling protrusion 166.

In this state, when the coupling member passes through the coupling protrusion 166 and is inserted into the coupling boss 183, the panel decor 18 may be stably coupled to the front case 16. Thereafter, to separate the panel decor 18, the coupling member inserted into the coupling boss 183 is separated, and then, when the pressing protrusion 184 is pushed forward, the panel decor 1 rotates in a second direction that is opposite to the first direction. Also, when the panel decor 18 is held and pulled forward, the coupling hook 182 is separated from the hook hole 168.

As illustrated as an arrow in FIG. 10, since the bent part 181*b* defined the lower end of the panel decor 18 is closely attached to the rear end of the door seating part 121, the water flowing down along the surface of the panel decor may not be introduced into the panel case 15 but be introduced into the washing drum through the door seating part 121. Thus, it may be possible to minimize the possibility that the electrical components accommodated in the panel case 15 due to moisture and moisture cause electric problems.

After the coupling of the panel cover 18 is completed, the rear case 17 is fixed and coupled to the front case 16.

The invention claimed is:

1. A washing machine comprising:

a cabinet configured to accommodate a washing drum;

a top cover which is seated on a top surface of the cabinet and on which a door seating part is disposed;

a door rotatably seated on the door seating part;

a panel case mounted on a rear portion of a top surface of the top cover and disposed at a rear side of the door, the panel case comprising a front case and a rear case coupled to a rear surface of the front case;

a control panel disposed on a front surface of the front case; and a panel decor coupled to the front surface of the front case, which corresponds to a lower side of the control panel, to cover a coupled portion of the front case and the top cover.

2. The washing machine according to claim 1, wherein each of left and right lower ends of the front surface of the front case comprises an extension end further extending forward than a rear end of the door seating part.

3. The washing machine according to claim 2, wherein the panel decor comprises at least one of:

a decor body having a length that is the same as or less than a width of the door seating part;

a plurality of coupling hooks protruding from an upper end of a rear surface of the door body;

a pair of coupling bosses respectively protruding from left and right points of the rear surface of the decor body;

a pair of pressing protrusions respectively protruding from left and right points of the rear surface of the decor body; and a plurality of movement prevention ribs extending from the rear surface of the decor body.

4. The washing machine according to claim 3, wherein a lower end of the decor body is bent or rounded downward and closely attached to the rear end of the door seating part.

5. The washing machine according to claim 3, further comprising at least one of:

a plurality of movement prevention grooves which are defined in a lower portion of the front surface of the front case and to which the plurality of movement prevention ribs are coupled;

a plurality of hook holes which are defined in the front surface of the front case and into which the plurality of coupling hooks are inserted;

an interference prevention hole defined in left and right sides of the front case to prevent an interference with the pressing protrusions; and a hook protrusion which is disposed at a rear side of the interference prevention hole and to which an end of each of the coupling bosses is closely attached.

6. The washing machine according to claim 3, wherein each of the pressing protrusions is disposed below each of the coupling bosses.

7. The washing machine according to claim 1, further comprising:

a plurality of fitting protrusions extending from a bottom surface of a front end of the front case; and a plurality of coupling holes defined in the bottom surface of the front end of the front case, which corresponds to positions between the plurality of fitting grooves.

8. The washing machine according to claim 7, further comprising:

a plurality of coupling slits defined at points along the top cover corresponding to positions of the plurality of fitting protrusions in the state in which the front case is seated on the top cover; and a plurality of coupling holes defined at points along the top cover corresponding to positions of the plurality of coupling holes defined in the bottom surface of the front end of the front case.

* * * * *